US009839074B2

(12) United States Patent
Kato et al.

(10) Patent No.: US 9,839,074 B2
(45) Date of Patent: Dec. 5, 2017

(54) CARBON BODY COATED WITH PYROLYTIC BORON NITRIDE, AND A CARBON HEATER INCLUDING THIS CARBON BODY

(71) Applicant: SHIN-ETSU CHEMICAL CO., LTD., Tokyo (JP)

(72) Inventors: Koji Kato, Annaka (JP); Waichi Yamamura, Annaka (JP)

(73) Assignee: SHIN-ETSU CHEMICAL CO., LTD., Tokyo (JP)

( * ) Notice: Subject to any disclaimer, the term of this patent is extended or adjusted under 35 U.S.C. 154(b) by 253 days.

(21) Appl. No.: 14/690,699

(22) Filed: Apr. 20, 2015

(65) Prior Publication Data

US 2015/0359042 A1 Dec. 10, 2015

(30) Foreign Application Priority Data

Jun. 5, 2014 (JP) ..... 2014-116380

(51) Int. Cl.
*H05B 1/02* (2006.01)
*H05B 3/42* (2006.01)
*H05B 3/14* (2006.01)

(52) U.S. Cl.
CPC ..... *H05B 3/42* (2013.01); *H05B 3/145* (2013.01); *Y10T 428/24942* (2015.01); *Y10T 428/30* (2015.01)

(58) Field of Classification Search
CPC .. H05B 3/42; H05B 3/145; H05B 1/02; Y10T 428/24942; Y10T 428/30
USPC ..... 219/200, 494, 505, 543, 548, 552; 428/408
See application file for complete search history.

(56) References Cited

U.S. PATENT DOCUMENTS 4,429,732 A * 2/1984 Moscrip ..... F28D 17/00 165/10
5,474,043 A * 12/1995 Mallen ..... F01C 3/025 123/241
2013/0302616 A1 11/2013 Kano

FOREIGN PATENT DOCUMENTS

CN 103387418 A 11/2013
JP 7-172963 A 7/1995
JP 2729289 B2 3/1998
JP 2013-234369 A 11/2013

OTHER PUBLICATIONS

Office Action dated Dec. 21, 2015, issued in counterpart Taiwanese Patent Application No. 104117883. (4 pages).

(Continued)

*Primary Examiner* — Mark Paschall
(74) *Attorney, Agent, or Firm* — Westerman, Hattori, Daniels & Adrian, LLP

(57) ABSTRACT

A PBN-coated carbon heater is disclosed in which the carbon base body is anisotropic with respect to thermal expansion coefficient such that the maximum-to-minimum coefficient ratio is 1.02 through 1.50 for temperatures between 50 and 800 degree C.; preferably the carbon base body is also anisotropic with respect to electric resistivity such that the maximum-to-minimum resistivity ratio is greater than 1.04 but not greater than 1.51, and the direction in which the resistivity is maximum coincides the direction of the heater pattern in which the electricity runs the longest distance.

5 Claims, 2 Drawing Sheets

(56) References Cited

OTHER PUBLICATIONS

Japanese Office Action dated Jul. 27, 2017, issued in counterpart Japanese Patent Application No. 2014-116380 with English translation.

* cited by examiner

CARBON BODY COATED WITH PYROLYTIC BORON NITRIDE, AND A CARBON HEATER INCLUDING THIS CARBON BODY

PRIORITY CLAIMED

The present non-provisional application claims priority, as per Paris Convention, from Japanese Patent Application No. 2014-116380 filed on Jun. 5, 2014, the disclosure of which is hereby incorporated by reference herein in its entirety.

FIELD OF TECHNOLOGY

The present invention relates to a carbon body (carbon-based body) coated with pyrolytic boron nitride, which is especially useful to make heaters and devices installed in equipment for manufacture of semiconductor devices, LED, solar cells, and the like; the invention also relates to a heater which includes the said carbon body. (Herein "carbon" means any carbonaceous material including graphite, etc. Hence a carbon heater can mean a graphite heater.)

BACKGROUND TECHNOLOGY

A carbon (base) body coated with pyrolytic boron nitride is known, and is generally classified, depending on the manufacture method, into molded, extruded and CIP (cold isostatic press). Graphite, which constitutes this carbon body, has a structure in which layers, each consisting of honeycomb-patterned plane with six-member carbon rings condensing together, are piled up, and this piling is maintained by very weak intermolecular pull force (namely, Van der Waals force), which works in the direction vertical to the layers. Each carbon atom constituting a member of any one of said six-member carbon rings is bonded with three neighboring carbon atoms thereby forming a highly rigid center of equiangularly oriented three covalent bonds in a plane.

Such special carbonaceous bodies are used to make structural members of a reacting furnace and heater members, and the ones made by CIP are the most commonly used. The CIP carbonaceous body, owing to its manufacturing method, is characteristic in that its six-member rings form a three-dimensionally arranged random body, and is hence isotropic. Also this special carbonaceous body can be made to have particular ranges of thermal expansion coefficient and electric resistivity, by selecting the manner by which a raw material coke is admixed.

The non-CIP carbonaceous bodies, that is, the molded carbonaceous body and the extruded carbonaceous body are built of coarse grains so that minute defects and pores are many in their surfaces and inside; hence they are not preferred to make structural members of a reacting furnace and heater members. With regard to the CIP carbonaceous body, although it is called isotopic graphite because it is manufactured by CIP method, it is in fact not easy to make a perfectly isotopic body owing to negative effects arising from shaping process and the self weight. In particular, the greater the size of the carbon block to be made is, the greater does the consequence of the self weight become, whereby problematic anisotropy is increased.

In recent years, in order to reduce the production cost, improvement in throughput is called for, and demand for large-sized carbon blocks is increasing. The reason for this is that although a large-sized carbon block is anisotropic in thermal expansion coefficient, a smart manner of dissecting it at once into many small-sized blocks can lead to a better cost reduction. Also by cunningly making use of the anisotropic nature of the large-sized carbon block, it becomes possible to make a carbon heater with increased durability.

Now, a coating layer made of pyrolytic boron nitride (hereinafter referred to as "PBN") is produced by CVD method, and the PBN layer (film) has properties of high insulation, high heat resistance and high flexibility. The structure of PBN is of a hexagonal system, similar to graphite, and the physical properties show an extensive anisotropy between the direction parallel to the growth plane [plane direction (a)] and a direction vertical to the growth plane [thickness-wise direction (c)]. Especially with respect to the thermal expansion coefficient, the difference is by about ten-fold: e.g., about $3.0\times10^{-6}$ [1/deg.C.] in direction (a) and about $30\times10^{-6}$ [1/deg.C.] in direction (c).

Now, PBN has a characteristic that the higher the degree of its orientation is, the greater does the contribution of covalent bonds in direction (a) become, whereby the thermal expansion coefficient becomes lower; on the other hand the lower the degree of its orientation is, the greater does the contribution of intermolecular force in dictions c becomes, whereby the heat expansion coefficient becomes higher; so that by changing the degree of orientation (anisotropy) it becomes possible to modify the thermal expansion coefficient When a carbon body is coated with a PBN layer with such useful properties, it becomes possible to use the carbon body even in a corrosive environment such as $H_2$ or $NH_3$ at high temperatures; hence a carbon body coated with PBN is used as a carbon heater and the like. However, the difference in the thermal expansion coefficient between the carbon body and the PBN layer would cause deformation, peeling off and cracking.

When used as a carbon heater, a PBN-coated carbon body experiences rapid raising and lowering of temperature, as it is desirable to shorten the operation so as to increase the throughput; as a consequence of this rapid operation, a temperature profile occurs in the heater to give rise to a buildup of thermal stress, which causes a crack in the PBN layer to expose the inner carbon body to be consumed.

In order to prevent the deformation, peeling off, cracking, etc., there have been proposed various countermeasures. For example, IP Publication 1 discloses a method for suppressing peeling off and cracking of the PBN layer through weakening of stress concentration, which is achieved by decreasing the surface roughness of the carbon body and chamfering the corners to a radius of curvature of 0.5 mm or greater. However, although this method may minimize the stress concentration at the corner areas, it is not possible by the method to mitigate the thermal stress which is created in the areas where the surface is highly flat by the effects of the thermal expansion coefficient difference and the temperature difference.

Also, IP Publication 2 discloses a method for forming a crack-free coating layer on a carbon base body by laying a PBN layer having a relatively low thermal expansion coefficient which is nearly equal to that of the carbon base body. However, owing to the fact that the thermal expansion coefficient of the PBN layer is necessarily greater than that of the carbon base body, this method cannot but fail, for when thermal stress is built by the repetition of temperature rising and falling, the stress causes a tensile stress to work on the PBN layer with a consequence that the latter is cracked.

As such, although the methods taught by the prior publications are effective in reducing the thermal stress between the PBN layer and the carbon base body, the effect obtained is not yet sufficient to solve the problem, for when the temperature rising and falling is repeated whereby the thermal load is imposed, the PBN layer is cracked.

PRIOR ART PUBLICATIONS

[IP Publications]
[IP Publication 1]
(Japanese) Patent Application Publication H07(1995)-172963
[IP Publication 2]
(Japanese) Patent Publication No. 2729289

BRIEF DESCRIPTION OF THE INVENTION

Problems the Invention Seeks to Solve

Hence the present invention was contrived in view of the above-stated circumstances, and it is an object of the invention to provide a carbon base body coated with a pyrolytic boron nitride layer and a carbon heater including this carbon base body, which are capable of solving the problems of cracking and breaking of the PBN layer.

The present inventors studied about the carbonaceous materials and the PBN materials with respect to the anisotropy with respect to their thermal expansion coefficients so as to attain the object of the invention, and came to find that, even in the case of a CIP carbonaceous body which has an isotropy with respect to thermal expansion coefficient, a PBN layer coated on this carbonaceous body would not peel off, if the ratio of the maximum thermal expansion coefficient to the minimum expansion coefficient (maximum/minimum) is in a certain range, and also that, if the thermal expansion coefficient of the PBN layer is approximated to the minimum thermal coefficient of the anisotropic CIP carbonaceous body, the PBN layer is effectively prevented from cracking or breaking—hence they possessed the invention.

Means to Solve the Problems

Therefore, the present invention relates to a carbon base body coated partially or entirely with a pyrolytic boron nitride thin layer, which is characteristic in that this carbon body has an anisotropy with respect to its thermal expansion coefficient such that, for temperatures between 50 and 800 degree C., the ratio of the maximum to the minimum of the thermal expansion coefficient (the maximum divided by the minimum) is 1.02 through 1.50.

Also, the present invention relates to such PBN-coated carbonaceous body which is characteristic in that the minimum thermal expansion coefficient of the carbonaceous body for temperatures between 50 and 800 degree C. is 2.0 ppm [1/deg.C.] through 5.0 ppm [1/deg.C.], and that the ratio of the thermal expansion coefficient of the pyrolytic boron nitride layer measured in a direction parallel to the immediate surface of the carbonaceous body to the minimum thermal expansion coefficient of the carbonaceous body is greater than 0.7 but smaller than 1.1.

Furthermore, the present invention relates to a carbonaceous heater which uses a combination of carbonaceous (base) body and the PBN layer that satisfy the above specified requirements; in particular, the carbonaceous body of the carbon heater has an anisotropy with respect to electric resistivity such that the ratio of the maximum electric resistivity to the minimum electric resistivity (maximum/minimum) is greater than 1.04 but less than 1.51, and also the direction in which the electric resistivity of the carbonaceous body exhibits its maximum value is identical to the direction of the heater pattern in which the electricity runs the longest distance.

Effects of the Invention

According to the present invention, it is possible to manufacture, at a low cost, a long-life, durable carbonaceous heater with PBN coating by cunningly cutting out from a large-sized carbonaceous block such as a commercially available CIP carbonaceous block which has anisotropy with respect to thermal expansion coefficient, so that an extensive cost reduction is attained.

Effects of the Invention

EXAMPLES TO EMBODY THE INVENTION

Now, embodiments of the present invention will be explained in detail based on experiments and manufacture examples; however, the scope of the present invention shall not be deemed to be limited by such experiments and examples.

Experiment 1

First, in Experiment 1, the anisotropy with respect to thermal expansion coefficient of a commercially available CIP material made of carbon was studied. The value of the thermal expansion coefficient was obtained by first measuring the differential thermal expansion of a sample for a temperature change of between 50 and 800 degree C. by means of Thermo Dilatometer DL7000 of ULVAC, Inc., and then dividing it by a sample length. The measurement is conducted with respect to mutually orthogonal X, Y, Z axes and the maximum and the minimum results of the three are entered in Table 1.

TABLE 1

| carbon base material | thermal expansion coefficient of carbon base body max. value $\times 10^{-6}$[1/° C.] | thermal expansion coefficient of carbon base body min. value $\times 10^{-6}$[1/° C.] | thermal expansion anisotropy (max. value)/(min. value) [—] |
|---|---|---|---|
| Material A | 3.2 | 2.0 | 1.60 |
| Material B | 3.0 | 2.0 | 1.50 |
| Material C | 3.2 | 2.5 | 1.28 |
| Material D | 3.6 | 3.0 | 1.20 |
| Material E | 3.8 | 3.1 | 1.23 |
| Material F | 3.9 | 3.5 | 1.11 |
| Material G | 4.2 | 3.8 | 1.11 |
| Material H | 4.5 | 4.2 | 1.07 |
| Material I | 4.8 | 4.5 | 1.07 |
| Material J | 5.1 | 5.0 | 1.02 |

From the results with respect to base materials A through J, it is confirmed that the commercially available CIP material made of carbon has anisotropy with respect to thermal expansion coefficient, and that the tendency is while the higher the thermal expansion coefficient (especially its minimum value) of the carbon body is, the lower will the anisotropic property be, whereas the lower the thermal expansion coefficient of the carbon base material is, the greater will the anisotropic property becomes.

Example 1

Figure 1:
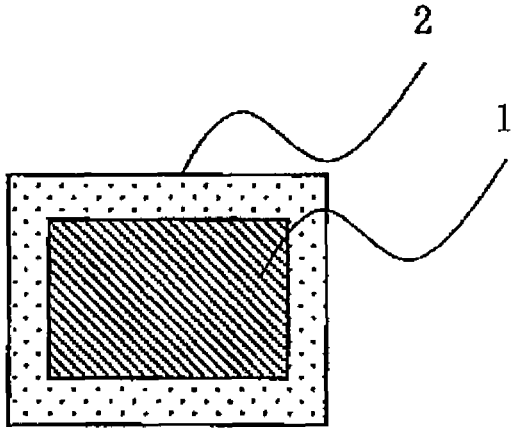
FIG. 1 is a schematic cross section of a carbon base body coated with a PBN layer.

Next, in Example 1, samples measuring 50 mm×50 mm×10 mm (thickness) were made from these carbon base materials which showed anisotropy in a manner such that the thickness-wise direction coincides with the direction in which the thermal expansion coefficient was maximum. These samples were set in a vacuum furnace separately and a 150-micrometer-thick PBN layer was laid on the carbon body samples by reacting $BCl_3$ with $NH_3$ gas at 1600-1800 deg. C. at 50 Pa. FIG. 1 is a conceptual cross section of a carbon base body 1 thus coated with PBN layer 2.

Figure 3:
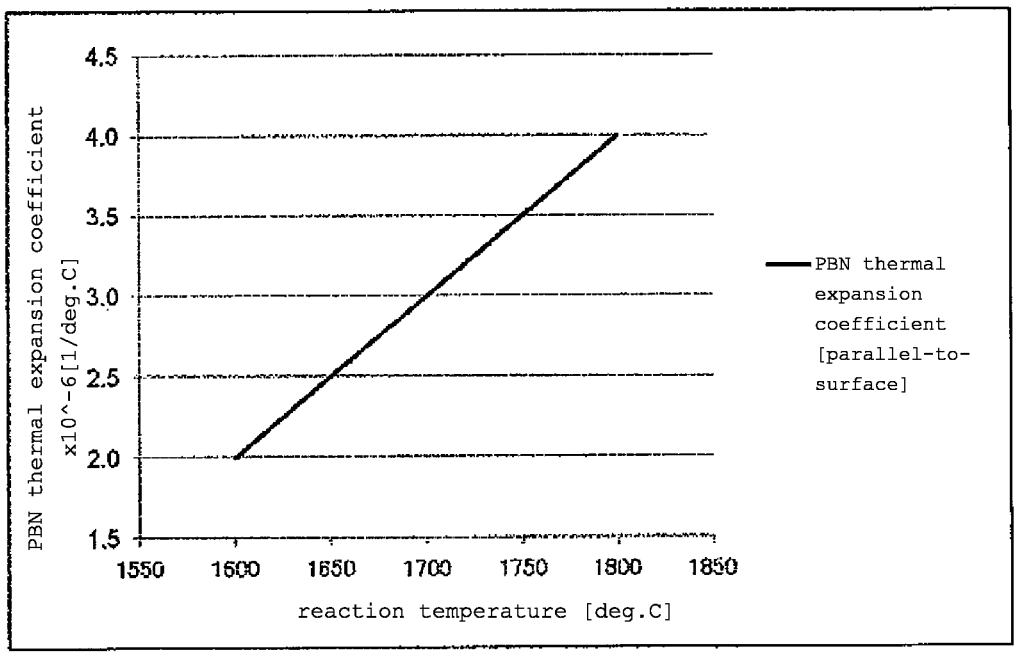
FIG. 3 A graph showing a relation between the thermal expansion coefficient of PBN layer measured in the direction parallel to the immediate surface of the carbonaceous body and the reaction temperature.

Also, as described above, the thermal expansion coefficient of the PBN layer is adjustable by controlling the reaction temperature. FIG. 3 is a graph showing a relationship between the reaction temperatures and the resultant thermal expansion coefficients as taken in a direction parallel to the surface of the PBN layer (that is, the coefficients taken in a direction parallel to the immediate surface of the carbon base). As is seen from FIG. 3, the thermal expansion coefficient in a direction parallel to the surface of the PBN layer is within a range of 2.0 ppm-4.0 ppm [1/deg.C.] when the reaction temperature is in the range of 1600-1800 deg.C., so that relying on this relationship the reaction temperature was controlled so as to approximate the thermal expansion coefficient of the PBN layer in the parallel-to-surface direction to that of the carbon base.

Table 2 shows how the thus-controlled thermal expansion coefficient in the parallel-to-surface direction of a PBN layer (film) relates to the thermal expansion coefficient of a carbon base.

ficient of the PBN film was measured after the PBN layer was removed from the carbon base material, in the manner as described with respect to the base body in Experiment 1.

From the above-stated outcome, it is found that although a commercially available carbonaceous CIP material is anisotropic to some extent with respect to thermal expansion coefficient, if the anisotropy in thermal expansion coefficient in terms of maximum-to-minimum ratio is not less than 1.02 and not greater than 1.50, such a carbonaceous CIP material can make a carbon base body from which the coated PBN layer would not peel off; on the other hand, if the ratio is greater than 1.50, the difference in thermal expansion coefficient between the PBN layer and the carbon base body becomes so great that PBN layer would peel off.

On the contrary, as will be explained herein-below, if a carbon base body has an anisotropy in thermal expansion coefficient such that the maximum-to-minimum ratio is as small as 1.02 or smaller, the advantageous effects of anisotropy are not sufficiently obtained—hence a range of 1.07 to 1.50 is preferable.

Also, from the above outcome, it is found that if the minimum value of the thermal expansion coefficient of a carbon base body is 2.0 ppm-5.0 ppm [1/deg.C.] it becomes possible to adjust the parallel-to-surface thermal expansion coefficient of the PBN layer to the range of 2.0 ppm-4.0 ppm [1/deg.C.] by controlling the reaction temperature so as to approximate the thermal expansion coefficient of the PBN layer to that of the carbon base body, whereby the PBN layer becomes less liable to peel off the carbon base body.

Hence, the present invention is characteristic in that in making a carbon base coated with PBN layer, the carbon base selected has such an anisotropy with respect to thermal expansion coefficient that when heated through 50-800 deg.C., the maximum thermal coefficient is greater than the minimum thermal coefficient by 1.02 through 1.50 times, or preferably by 1.07 through 1.50 times.

TABLE 2

| carbon base material | thermal expansion coefficient of carbon base body max. value $\times 10^{-6}$[1/° C.] | thermal expansion coefficient of carbon base body min. value $\times 10^{-6}$[1/° C.] | thermal expansion anisotropy (max. value) (min. value) [—] | thermal expansion coefficient of PBN (parallel-to-surface) $\times 10^{-6}$[1/° C.] | PBN-to-carbon ratio of thermal expansion coefficient (PBN)/(min. value of carbon) [—] | appearance |
|---|---|---|---|---|---|---|
| Material A | 3.2 | 2.0 | 1.60 | 2.0 | 1.00 | film peel-off |
| Material B | 3.0 | 2.0 | 1.50 | 2.0 | 1.00 | good |
| Material C | 3.2 | 2.5 | 1.28 | 2.3 | 0.92 | good |
| Material D | 3.6 | 3.0 | 1.20 | 2.8 | 0.93 | good |
| Material E | 3.8 | 3.1 | 1.23 | 2.8 | 0.90 | good |
| Material F | 3.9 | 3.5 | 1.11 | 3.3 | 0.94 | good |
| Material G | 4.2 | 3.8 | 1.11 | 3.4 | 0.89 | good |
| Material H | 4.5 | 4.2 | 1.07 | 3.8 | 0.90 | good |
| Material I | 4.8 | 4.5 | 1.07 | 4.0 | 0.89 | good |
| Material J | 5.1 | 5.0 | 1.02 | 4.0 | 0.80 | good |

According to the result shown in Table 2, the sample made from the carbon base material A was observed to suffer peeling of the PBN film from a side face of the sample, and this is thought to be caused by a significant difference in the thickness-wise thermal expansion coefficient between the carbon base material and the PBN layer. The other samples made from carbon base materials B through J were observed to have no peeling off of the PBN film and had good appearance. The parallel-to-surface thermal expansion coef- Also, a preferable version of the present invention is that the minimum thermal expansion coefficient of the carbon base is 2.0 ppm [1/deg.C.]-5.0 ppm [1/deg.C.].

According to the present invention, it is possible to manufacture, at a low cost, a PBN-overcoat carbon body from a commercially available large-sized carbon block which has anisotropy with respect to thermal expansion coefficient, by cutting the carbon block to a carbon body in a cunning manner such that the PBN layer deposited on it does not peel off or crack; hence a significant cost down is gained.

Example 2

Next, in Example 2, the base material F was selected from the base materials B though J used in Example 1, which did not suffer peeling of PBN layer, and 8 samples of carbon heaters (F-1 through F-8) were made from this, each measuring 500 mm in total length, 10 mm in width and 4 mm in thickness and each equipped with an electrode connecting fixture at both ends; in this making of the samples, the thickness direction of each sample was made to coincide the direction in which the thermal expansion coefficient was the maximum. These sample carbon heaters were individually placed in a vacuum furnace, and were coated with a 150-micrometer-thick PBN layer, which was deposited as a product of a reaction between $BCl_3$ and $NH_3$ gas at 1600-1800 deg.C. and 50 Pa, and hence carbon heaters F-1 through F-8 were obtained.

Figure 2:
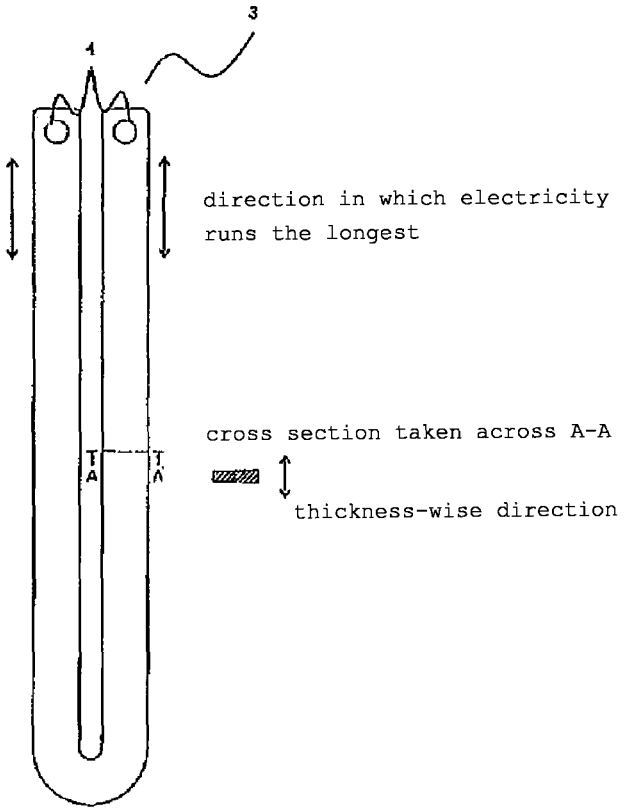
FIG. 2 is a schematic drawing showing a carbonaceous heater made of a carbonaceous body and coated with a PBN layer.

On this occasion, by selecting different reaction temperatures on the basis of the relation between the thermal expansion coefficient of PBN and the reaction temperature shown in FIG. 3, it is possible to arbitrarily adjust the resultant parallel-to-surface thermal expansion coefficient of the PBN layer, and thereby carbon base bodies with PBN layers having various thermal expansion coefficients were prepared. FIG. 2 shows a carbon heater 3 which was manufactured in this manner, and it has an electrode connecting fixture 4 at each end.

It seems from this result that, from the viewpoint of the importance of the durability against the temperature rise and fall reciprocated between the room temperature and 1400 deg.C., a preferable embodiment is such that the ratio of the parallel-to-surface thermal expansion coefficient of the PBN layer to the minimum value of the thermal expansion coefficient of the carbon base material is greater than 0.7 but smaller than 1.1, for in such a case the differential thermal expansion coefficient between the PBN film and the carbon base material is small enough. With this type of PBN coated carbon base material, the differential expansion between the PBN film and the carbon base material will be small so that the tensile stress that works on the PBN film will be so small that the PBN film would be prevented from cracking and breaking.

On the other hand, if the said ratio is 1.1 or greater, the tensile stress that works on the PBN film becomes so large that the possibility of incurring cracking of the PBN film becomes unacceptably high. If the ratio is 0.7 or smaller, the difference between the maximum thermal expansion coefficient of the carbon base material and the thermal expansion coefficient of the PBN film becomes so large that there will be a fear of peeling off of the PBN film. Therefore, it is more preferable that the ratio is not smaller than 0.8 but smaller than 1.0, and such a PBN-coated carbon base material is free of cracking and peeling off of the PBN film, because the PBN film is always under such stress that tries to shrink it.

TABLE 3

| carbon base material | thermal expansion coefficient of carbon base body max. value $\times 10^{-6}$[1/° C.] | thermal expansion coefficient of carbon base body min. value $\times 10^{-6}$[1/° C.] | thermal expansion anisotropy (max. value) (min. value) [—] | expansion coefficient of PBN $\times 10^{-6}$[1/° C.] | PBN-to-carbon ratio of thermal expansion coefficient (PBN)/(min. value of carbon) [—] | appearance |
|---|---|---|---|---|---|---|
| Material F-1 | 3.9 | 3.5 | 1.11 | 2.0 | 0.57 | film peel-off |
| Material F-2 | 3.9 | 3.5 | 1.11 | 2.3 | 0.66 | film peel-off |
| Material F-3 | 3.9 | 3.5 | 1.11 | 2.5 | 0.71 | good |
| Material F-4 | 3.9 | 3.5 | 1.11 | 2.8 | 0.80 | good |
| Material F-5 | 3.9 | 3.5 | 1.11 | 3.2 | 0.91 | good |
| Material F-6 | 3.9 | 3.5 | 1.11 | 3.6 | 1.03 | good |
| Material F-7 | 3.9 | 3.5 | 1.11 | 3.8 | 1.09 | good |
| Material F-8 | 3.9 | 3.5 | 1.11 | 4.0 | 1.14 | cracked |

According to the results shown in Table 3, although peeling off of the PBN film was observed in the cases of carbon heater samples which were made from carbon base materials F-1 and F-2, there was no peel-off of PBN film in other carbon heaters.

The heater samples made from carbon base materials F-3 through F-8, which did not suffer peeling off of the PBN film, were set in a vacuum furnace, and after being connected to the power source, the samples were heated under a reduced pressure of 10 Pa to reciprocate 10 times between the room temperature and 1400 deg.C., and the samples of F-3 through F-7 maintained good appearance, but the sample of F-8 had a crack in its PBN film layer.

Therefore, the present invention is characteristic in that the ratio of the parallel-to-surface direction thermal expansion coefficient of the PBN film to the minimum value of the thermal expansion coefficient of the carbon base material is greater than 0.7 but smaller than 1.1.

Experiment 2

Next, in Experiment 2, anisotropy with respect to electric resistivity was also studied. In particular, the electric resistivity values of the carbon base materials B, E, I and J, which ended up having good appearance as shown in Table 2, were studied to inquire about a presence of anisotropy. For the measurement of the electric resistivity, carbon test pieces measuring 5 mm×5 mm×100 mm were prepared and their resistivity was measured by four-terminal method using a resistance meter R3544 manufactured by HIOKI E.E. CORPORATION, and from the resistivity the its anisotropic ratio was calculated. Table 4 shows the result of the measurement.

TABLE 4

| carbon base material | thermal expansion coefficient of carbon base body max. value $\times 10^{-6}$[1/° C.] | thermal expansion coefficient of carbon base body min. value $\times 10^{-6}$[1/° C.] | thermal expansion anisotropy (max. value) (min. value) [—] | electric resistivity of carbon base body max. value [micro-ohm-meter] | electric resistivity of carbon base body min. value [micro-ohm-meter] | electric resistivity anisotropy (max. value) (min. value) [—] |
|---|---|---|---|---|---|---|
| Material B | 3.0 | 2.0 | 1.50 | 23.3 | 15.4 | 1.51 |
| Material E | 3.8 | 3.1 | 1.23 | 21.0 | 16.7 | 1.26 |
| Material I | 4.8 | 4.5 | 1.07 | 18.1 | 16.7 | 1.08 |
| Material J | 5.1 | 5.0 | 1.02 | 15.2 | 14.6 | 1.04 |

From the result entered in Table 4, it was confirmed that the commercially available carbonaceous CIP material has an isotropy with respect to electric resistivity similar to that with respect to thermal expansion coefficient.

Example 3

So in the next Experiment 3, carbon heaters measuring 500 mm in total length, 10 mm in width and 3.6-5.8 mm in thickness and each equipped with an electrode connecting fixture at both ends were made from these carbon base materials B, E, I and J, two kinds of such heaters in each case. Then, in order to adjust the resistivity of each carbon heater to about 190-210 micro-ohm, the thickness of each of the two kinds of the heater was changed. Next, these samples were set in a vacuum furnace separately and a 150-micrometer-thick PBN layer was deposited on the carbon body samples by reacting $BCl_3$ with $NH_3$ gas at 1600-1800 deg. C. at 50 Pa. Now, on this occasion, relying on the fact that the thermal expansion coefficient of the PBN film is adjustable by altering the reaction temperature, the thermal expansion coefficient PBN film was thus adjusted and carbon base bodies coated with PBN layers having different thermal expansion coefficient were obtained.

The thus prepared sample carbon heaters were individually placed in a vacuum furnace, and after being connected to the power source, the samples were heated to 1400 deg.C. under a reduced pressure of 100 Pa. Thereafter, the sample heaters were subjected to a flow of ammonia gas at a rate of 6 L/min so as to estimate their durability. Table 5 shows the result of the test.

TABLE 5

| carbon base material | Direction in which maximum resistivity occurs | heater thickness mm | heater resistivity mΩ | hours before heater breakage occurred hrs | |
|---|---|---|---|---|---|
| Material B | thickness-wise | 3.9 | 197 | 387 | present invention |
| | pattern-wise | 5.8 | 201 | 713 | |
| Material E | thickness-wise | 4.2 | 206 | 415 | present invention |
| | pattern-wise | 5.3 | 191 | 584 | |
| Material I | thickness-wise | 4.2 | 201 | 418 | present invention |
| | pattern-wise | 4.5 | 199 | 491 | |
| Material J | thickness-wise | 3.7 | 198 | 351 | not present invention |
| | pattern-wise | 3.8 | 200 | 358 | |

According to the result shown in Table 5, it is seen that in the cases of the carbon heaters made of the carbon base materials B, E, or I, the kind of the heater wherein the direction in which the electric resistivity is maximum coincides the direction of the pattern in which the electric current runs the longest distance, has a similar resistivity to the other kind of the heater wherein the direction in which the electric resistivity is maximum is the thickness-wise direction, even when the thickness of the former kind of heater is made greater, and furthermore it is found that the former kind of heater has greater durability in that the time it took before the heater broke was longer.

On the other hand, in the case of the carbon heaters made of the carbon base material J, there were only small differences in terms of heater thickness, resistivity, and the time span before the heater broke, between the two kinds of the heaters wherein the direction in which the electric resistivity is maximum coincides the direction of the pattern in which the electric current runs the longest distance or the thickness-wise direction. This is thought to be caused by the fact that the degree of anisotropy was low in the case of the carbon base material J compared to the other carbon base materials B, E, and I.

From the above-mentioned results, it is possible that a carbon heater of the present invention includes a carbon base material which is characteristic in that it has an anisotropy with respect to electric resistivity such that the ratio of the maximum electric resistivity to the minimum electric resistivity (maximum/minimum) is greater than 1.04 but not greater than 1.51; if this ratio is 1.04 or lower, the anisotropy degree is so small that the beneficial effects of being anisotropic are not obtained. On the other hand, if this ratio is greater than 1.51, the thermal expansion coefficient ratio also becomes so large that the possibility of peeling off of the PBN film or the like becomes unacceptable.

Also, in the carbon heater of the present invention, it is preferable that the direction in which the electric resistivity of the carbon base body becomes maximum coincides the direction of the pattern in which the electricity runs the longest distance. By thus designing, it becomes possible to increase the heater thickness while the resistivity remains about the same, whereby the strength and the like of the heater can be improved. It is hence possible to increase the cross section across which the electricity runs, so that the current density is lowered and the durability of the carbon against the corrosive gases is improved and the life of the carbon heater (time span before the heater breaks) can be extended.

REPRESENTATION OF REFERENCE NUMERALS

1: carbon base body
2: PBN layer (film)
3: carbon heater comprising a carbon base body coated with PBN layer
4: electrode connecting fixture of carbon heater

The invention claimed is:

1. A PBN-coated carbon heater comprising:
a carbon base; and
a pyrolytic boron nitride layer with which said carbon base is partially covered,
wherein said carbon base has an anisotropy with respect to thermal expansion coefficient in a manner such that a ratio of its maximum thermal expansion coefficient to its minimum thermal expansion coefficient is 1.02 through 1.50 as measured for temperatures between 50 and 800 degree C.,
wherein said carbon base has an anisotropy with respect to electric resistivity in a manner such that its maximum electric resistivity is 1.04 through 1.51 times greater than its minimum electric resistivity, and
wherein a direction in which electric resistivity of said carbon base becomes maximum coincides a direction of said heater pattern in which the electricity runs the longest distance.

2. A PBN-coated carbon body as claimed in claim 1, wherein said minimum thermal expansion coefficient for temperatures between 50 and 800 degree C. is $2.0\times10^{-6}$/degree C. through $5.0\times10^{-6}$/degree C.

3. A PBN-coated carbon body as claimed in claim 1, wherein a ratio of thermal expansion coefficient of said pyrolytic boron nitride layer measured in a direction parallel to an immediate surface of said carbon base to said minimum thermal expansion coefficient of the carbon base is greater than 0.7 but smaller than 1.1.

4. A carbon heater comprising a PBN-coated carbon body as claimed in claim 1, wherein said carbon body is shaped into a heater pattern.

5. A carbon heater as claimed in claim 4, wherein said carbon base has a maximum thermal expansion coefficient which is 1.07 through 1.50 times greater than a minimum thermal expansion coefficient thereof for temperatures between 50 and 800 degree C.

* * * * *